US010168005B2

(12) United States Patent
Zhu

(10) Patent No.: US 10,168,005 B2
(45) Date of Patent: Jan. 1, 2019

(54) LED ILLUMINATION DEVICE WITH ARBITRARY BENDING AND FIXING CONNECTOR MODULE

(71) Applicant: HUNAN YUEGANG MOOKRAY INDUSTRIAL CO., LTD., Changde (CN)

(72) Inventor: Heng Zhu, ShenZhen (CN)

(73) Assignee: HUNAN YUEGANG MOOKRAY INDUSTRIAL CO., LTD., Changde (CN)

( * ) Notice: Subject to any disclaimer, the term of this patent is extended or adjusted under 35 U.S.C. 154(b) by 0 days.

(21) Appl. No.: 15/567,081

(22) PCT Filed: May 5, 2017

(86) PCT No.: PCT/CN2017/083178

§ 371 (c)(1),
(2) Date: Oct. 17, 2017

(87) PCT Pub. No.: WO2017/152885

PCT Pub. Date: Sep. 14, 2017

(65) Prior Publication Data

US 2018/0149317 A1 May 31, 2018

(30) Foreign Application Priority Data

Mar. 7, 2016 (CN) ..... 2016 1 0127500
Mar. 30, 2016 (CN) ..... 2016 1 0193264
(Continued)

(51) Int. Cl.
*F21K 9/237* (2016.01)
*F21K 9/238* (2016.01)
(Continued)

(52) U.S. Cl.
CPC ..... *F21K 9/237* (2016.08); *F21K 9/23* (2016.08); *F21K 9/238* (2016.08); *F21K 9/69* (2016.08)

(58) Field of Classification Search
CPC .. F21S 2/005; F21S 4/22; F21V 23/06; F21V 21/005
(Continued)

(56) References Cited

U.S. PATENT DOCUMENTS 7,204,618 B1 * 4/2007 Kuelbs ..... F21S 9/037 362/35
9,416,922 B1 * 8/2016 Stagni ..... F21K 9/135
(Continued)

FOREIGN PATENT DOCUMENTS

CN 204901392 U 12/1923
CN 204118132 U * 1/2015
(Continued)

OTHER PUBLICATIONS

Zhu Heng, In-line integrated LED lamp bead and LED lamp, Jan. 21, 2015, Patent Pub CN204118132U; Google Patents, https://patents.google.com/patent/CN204118132U/en.*

*Primary Examiner* — Anh Mai
*Assistant Examiner* — Michael Chiang
(74) *Attorney, Agent, or Firm* — Gokalp Bayramoglu

(57) ABSTRACT

The present invention relates to an LED illuminating device, which includes a lamp cover, a housing, and a base formed in a standardized general modularized manner that can be combined to form the desired appearance of the illuminating device. Also, a lens decorative lighting member, which uses general screw-in manner, is included. The lens decorative lighting member can act as both decorative lighting and lens. The elected lens decorative lighting member can change the light emitting angle and the color temperature arbitrarily. A
(Continued)

plug-in integrated light source module consisting of lamp bead and the heat sink is further included. A plug-in three-dimensional circuit-connecting component, which replaces the existing PCB, is further included to form a general component, which can be arbitrarily bent, fixed, and tailored. A plug-in power supply module is further included, wherein additional functions can be arbitrarily selected and replaced based on demands.

2 Claims, 20 Drawing Sheets

(30) Foreign Application Priority Data

Mar. 30, 2016 (CN) ..... 2016 1 0193265
Jun. 24, 2016 (CN) ..... 2016 1 0478569
Jun. 24, 2016 (CN) ..... 2016 1 0479251
Jun. 24, 2016 (CN) ..... 2016 1 0479318

(51) Int. Cl.
*F21K 9/69* (2016.01)
*F21K 9/23* (2016.01)

(58) Field of Classification Search
USPC ..... 362/367
See application file for complete search history.

(56) References Cited

U.S. PATENT DOCUMENTS 9,464,770 B2 * 10/2016 Morgan ..... F21V 21/005
2004/0050871 A1 * 3/2004 Delage ..... B65D 47/261 222/212
2006/0134978 A1 * 6/2006 Rosen ..... A63H 33/042 439/581
2008/0101070 A1 * 5/2008 Chou ..... F21K 9/00 362/249.01
2009/0196034 A1 * 8/2009 Gherardini ..... F21K 9/00 362/235
2012/0057349 A1 * 3/2012 Loraing ..... F21S 2/005 362/249.02
2013/0027915 A1 * 1/2013 Caferro ..... F21V 29/004 362/147
2014/0185295 A1 * 7/2014 Presswood, Jr. ..... F21V 21/14 362/249.08
2015/0219328 A1 8/2015 Lee et al.
2015/0308671 A1 * 10/2015 Tischler ..... H01S 5/042 362/235

FOREIGN PATENT DOCUMENTS

CN 204268150 U 4/2015
CN 204901392 U 12/2015
CN 105627122 A 6/2016
CN 105633256 A 6/2016
CN 105674224 A 6/2016
CN 105979705 A 9/2016
CN 106015977 A 10/2016
CN 205909036 U 1/2017

* cited by examiner

LED ILLUMINATION DEVICE WITH ARBITRARY BENDING AND FIXING CONNECTOR MODULE

CROSS REFERENCE TO RELATED APPLICATIONS

This application is the national phase of International Application No. PCT/CN2017/083178, filed on May 5, 2017, which is based upon and claims priority to Chinese Patent Applications 201610479318.1 filed on Jun. 24, 2016, 201610478569.8 filed on Jun. 24, 2016, 201610193264.2 filed on Mar. 30, 2016, 201610479251.1 filed on Jun. 24, 2016, 201610127500.0 filed on Mar. 7, 2016, and 201610193265.7 filed on Mar. 30, 2016, the entire contents of which are incorporated herein by reference.

TECHNICAL FIELD

The present invention relates to the field of illuminating technology and particularly to an LED illuminating device with arbitrary bending and fixing connector module.

BACKGROUND

With the development of science and technology, LED solid illuminating light source is used more and more broadly. The LED solid illuminating light source is also used as the illuminating light source with increasing popularity. Currently, there are problems in the field of LED illuminating technology as follows:

1. The LED illuminating device and traditional products are homogenized in terms of appearance and structure. No differentiation has been generated, which results in a direct price competition.

2. All the products are the same in terms of structures and modes. All of them have fatal problems such as the difficulty of heat dissipation of the chip, high cost, and so on.

3. The appearance, the structure, and the design mode are homogenized. However, specific materials used by different producers cannot be replaced by one another.

SUMMARY

Regarding the defects in the prior art, the present invention provides an LED illuminating device with an arbitrary bending and fixing connector module. The specific technical solutions of the LED illuminating device with the arbitrary bending and fixing connector module of the present invention are as follows:

An LED illuminating device with an arbitrary bending and fixing connector module includes:

a frame member module; the frame member module includes a frame member; the frame member includes a frame member cylindrical plastic metal composite part A and a snap-in connecting part; the outer layer of the cylindrical plastic metal composite part A is plastic, and the core is metal strip; each side surface of the cylindrical plastic metal composite part A has a concave snap-in groove structure; the snap-in connecting part is configured to be a structure to snap in the concave snap-in groove structure;

a housing of the lamp, cover, or piece-like internal and external cavity wall module; the housing of the lamp, cover, piece-like internal and external cavity wall module has a flexible metal piece shape, plastic piece-like, fabric film, paper, or a piece-like module with any combination; the piece-like module material is inserted into a concave snap-in groove structure in the frame member to form an internal or external housing of lamp, or form a closed or unclosed cavity inside the lamp; a design and pattern is carved, coated, sprayed, or printed on a surface of the piece-like material is used as a decoration of the lamp;

a housing supporting and molding member module; the housing supporting and molding member module includes a supporting and molding member; the supporting and molding member has a multilayer piece-like structure; the number of layers is N; N is an odd number which is equal to or greater than 3; the multilayer structure is arranged from top to bottom in an order of one plastic layer and one metal layer in an alternate manner; the uppermost layer and the lowermost layer are plastic layers; the mechanical strength of the supporting and molding member is configured in such a way that the supporting and molding member can be arbitrarily bent or tailored by manpower to form the supporting member of the housing of the lamp, the cover, or the flexible film material of the lamp;

a decorative fastening member module; the decorative fastening member module includes cylindrical plastic metal composite part B, H-shaped snap-in connecting part, L-shaped or U-shaped fastening sealing strip with a snap joint; each side surface of the cylindrical plastic metal composite part B is provided with a concave snap-in groove structure; the H-shaped snap-in connecting part is configured to be a structure snapping in the concave snap-in groove structure of the cylindrical plastic metal composite part B; a middle portion of each H-shaped snap-in connecting part is provided with a via hole; the L-shaped or U-shaped fastening sealing strip with the snap joint is configured to snap in an external side surface of the cylindrical plastic metal composite part B;

further includes a screw-in lens and decorative lighting module in which the lens and decorative lighting can be replaced arbitrarily; the screw-in lens and decorative lighting module includes a screw-in secondary light distribution lens; an internal side of an outer wall of the secondary light distribution lens is fixed to the plug-in integrated light source module in a screw-in manner;

further includes a plug-in integrated light source module; the plug-in integrated light source module includes a lamp bead body, an LED chip and circuit, and a plug-in component; wherein the lower part of the lamp bead body is designed as a heat dissipation structure; the upper part of the lamp bead body is packaged with the LED chip and circuit; the plug-in integrated light source module has an integrated whole packaging structure; the plug-in integrated light source module is plugged on the modular light bar through the plug-in component;

further includes a plug-in three-dimensional circuit connector module which can be bent and fixed arbitrarily; the plug-in three-dimensional circuit connector module includes a connector; the connector includes a plurality of connecting units which can be bent and fixed arbitrarily and is provided with connecting points; the connecting units, which can be bent and fixed arbitrarily, are connected to each other through connecting points; and further includes a plug-in power supply module; the plug-in power supply module is fixedly plugged in and electrically connected to an electrical connecting port of the plug-in integrated light source module.

According to a preferred embodiment, the plug-in integrated light source module is an LED lamp with remote fluorescent powder structure in which the color temperature of the light source can be adjusted. The LED lamp with remote fluorescent powder structure in which the color temperature of the light source can be adjusted, includes an LED chip-heat sink integrated lamp bead formed by the lamp bead body, and the LED chip and circuit. A central portion of an upper surface of the integrated lamp bead is provided with a chip illuminating cup cavity. The LED chip is fixed on a metal surface inside the chip illuminating cup cavity. The LED chip and circuit is connected to positive and negative poles and is packaged by adhesive dispensing. A cup cavity wall of the chip illuminating cup cavity is a circular plastic part or a metal part. An internal wall of the chip illuminating cup cavity has an oblique angle. An outer wall of the chip illuminating cup cavity has a right-angled threaded shape. A ring is provided to be fixed to and detached from an outer wall of the chip illuminating cup cavity in a screw-in manner. A center of the ring includes a hole. A diameter of the hole is the same as an external diameter of the chip illuminating cup cavity. An upper portion of the hole is provided with a plastic fluorescent lens. A lower portion of the ring is provided with female threads. The female threads are configured to correspondingly screw in male threads of the cup cavity, such that the plastic fluorescent lens and the chip illuminating cup cavity are attached to each other closely. A layer of transparent silicon resin paste is applied between the plastic fluorescent lens and chip packaging adhesive layer, such that luminous efficacy can be improved. At the same time, the plastic fluorescent lens and the chip illuminating cup cavity attach to each other seamlessly. The light emitted from the LED chip exits through the plastic fluorescent lens at the middle portion of the ring and stimulates the fluorescent powder to emit light with desired color temperature and chromatograph.

According to a preferred embodiment, the secondary light distribution lens and the plastic fluorescent lens attach to each other closely. The internal side of the outer wall of the secondary light distribution lens is fixed to the integrated lamp bead in a screw-in manner.

According to a preferred embodiment, the plastic fluorescent lens includes a bluish white light lens, a true white light lens, and a yellowish white light lens. The formula of the bluish white light lens is white light paste:curing agent: bluish white light fluorescent powder=1:1:(0.07-0.09). The formula of the true white light lens is white light paste: curing agent:true white light fluorescent powder=1:1: (0.085-0.12). The formula of the yellowish white light lens is white light solution:b curing agent:yellowish white light fluorescent powder=1:1:(0.11-0.15).

According to a preferred embodiment, the plug-in integrated light source module is an LED light source module directly, which uses a metal heat sink as positive and negative pole circuits directly. The lamp bead body is a metal body A. The metal body A is formed by n little metal bodies B that are of the same or different shapes, insulative of each other, and connected to each other fixedly, wherein n>=2. A surface of each little metal body B is provided with m LED chips with the same or different number, wherein m>=1. Adjacent LED chips are connected to each other in series or in parallel. Each little metal body B is provided with a plurality of circuit connecting points, so as to form a circuit. Except for the circuit connecting points, the surface of the little metal body B is insulative. The LED chip is directly adhered to or fixed to the little metal body B by welding. At the same time, silica gel covers the chip and the connecting circuit. Each little metal body B, based on the design requirement of the entire circuit, is designed to have a plurality of positive poles or negative poles. The plurality of positive poles or negative poles is connected to the chip on the little metal body B either in series, in parallel, or a hybrid serial-parallel manner. The plurality of positive poles or negative poles is connected to positive poles or negative poles on other little metal bodies. The plurality of positive poles or negative poles can be connected to the external circuit to form a desired whole circuit. The metal body A formed by a plurality of little metal bodies B, is used as the heat sink of the LED light source module and further as the positive and negative poles circuit of the LED light source module.

According to a preferred embodiment, the plug-in integrated light source module is a plug-in LED chip-heat sink integrated light source and lens structure. The lamp bead body is a metal body. The metal body is provided with the chip and the cup cavity. The cup cavity is provided with positive and negative poles. Positive and negative pins corresponding to the positive and negative poles form a male plug by injection molding to directly reach a heat dissipation structure. The male plug is connected to an external female plug to turn on the circuit. The upper portion of the cup cavity is provided with a lens. An external diameter of the lens is the same as that of the cup cavity. The lens and the central hole of the metal piece are connected and integrated as a whole by injection molding, which is screwed on the cup cavity. The LED illuminating device_with the arbitrary bending and fixing connector module further includes a metal part. The secondary light distribution lens and the metal part are fixed as a whole by injection molding or in a snap-in manner. A joint surface between the secondary light distribution lens and the metal part is subject to a reflective process. The light that is refracted by the lens can be reflected effectively. A bottom of the metal part is provided with threads and a plastic gasket. The metal part is fixed together to the metal body through threads in a screw-in manner.

According to a preferred embodiment, the plug-in integrated light source module includes a plurality of cuboid lamp beads. A geometric center of an upper surface of the lamp bead body of each cuboid lamp bead is provided with a projecting lamp cup by injection molding. The lamp cup is an inversed flat-topped quadrangular pyramid groove. The lamp cup is provided with the LED chip. The lens is provided in the illuminating optical path of LED and is configured to diffuse rays. An upper surface the lamp bead body is further provided with two grooves. The two grooves are positioned on both sides of the lamp cup and correspond to each other. The positive and negative poles circuits are provided in the two grooves. The positive and negative pole circuits of the lamp bead are wrapped within the two grooves by injection molding to achieve insulation. One end of the positive and negative pole circuits is connected to the LED chip. The other end of the positive and negative pole circuits is exposed to the outside of the groove. The positive and negative poles on both sides of the lamp bead form male plugs of male and female plug structure by injection molding. The end of the positive and negative pole circuits, which are exposed to the outside of the groove, are positioned in the male plug. A lower part of the lamp bead body is configured to be a heat dissipation structure.

According to a preferred embodiment, the heat dissipation structure in the plug-in integrated light source module is heat dissipation column, heat dissipation wing, or heat dissipation fin.

According to a preferred embodiment, the plug-in three-dimensional circuit connector module, which can be bent and fixed arbitrarily, is a circuit connector. The circuit connector includes a flexible circuit board and a piece-like or cavity-shaped fixing component, which can be bent and fixed arbitrarily. The flexible circuit board includes a flexible circuit and a plurality of male plugs or female plugs fixed on the flexible circuit. The plug of the male plug or female plug is provided with a plurality of circuit plug-in points or welding points. A surface of the fixing component is provided with through opening or non-through local concave point or concave surface. A surface of the fixing component is provided with a plurality of location holes. The flexible circuit board and an electronic device provided on the flexible circuit board can be mounted and fixed in the through opening or on the non-through local concave point or concave surface of the component. The size of the male plug or female plug corresponds to the location of the opening, the concave point, and the concave surface on the surface of the component, such that the flexible circuit board and discrete electronic devices or modular devices provided on the flexible circuit board completely attach to and snap in on the surface of the above fixing component, or is directly provided in an opening space of the fixing component.

According to a preferred embodiment, the plug-in three-dimensional circuit connector module, which can be bent and fixed arbitrarily, is a circuit connector. The circuit connector includes an insulative flexible circuit board and a plurality of male and female plugs and adaptors. Through different plug-in manners, series circuit, parallel circuit, or hybrid circuit can be formed.

Compared with the prior art, the present invention has the following advantages:

1. In the present invention, there are three types of general modules, i.e., the frame member module, the housing of lamp, the cover, the piece-like internal and external cavity wall module, and housing supporting and molding member module. The three types of general modules can be combined into any desired light housing arbitrarily. Thus, the generalization, modularization, and diversification of the external structure of the lamp can be achieved. From now on, the traditional mode in which each lamp has its own mold is terminated.

2. The present invention uses the plug-in integrated light source module and the circuit connector that can be bent arbitrarily. Thus, the adaptiveness of the components of the lamp is greatly improved. Therefore, the lamp that is general, optional, replaceable, and modular is realized.

BRIEF DESCRIPTION OF DRAWINGS

FIG. 18 (*b*) is the side view of the plastic fluorescent lens which is arc lens in Embodiment 2;

FIG. 19 (*b*) is the side view of the plastic fluorescent lens which is Fresnel lens;

DETAILED DESCRIPTION

Hereinafter, with reference to the drawings, the present invention is described in detail.

Embodiment 1

As shown in FIG. 1 to FIG. 16, the LED illuminating device with the arbitrary bending and fixing connector module of the present embodiment includes a frame member module, a housing of the lamp, a cover, a piece-like internal and external cavity wall module, a housing supporting and molding member module, a decorative fastening member module, a screw-in lens and decorative lighting module in which the lens and decorative lighting can be replaced arbitrarily, a plug-in integrated light source module consisting of a lamp bead and a heat sink, a plug-in three-dimensional circuit connector module which can be arbitrarily bent and fixed, and a plug-in power supply module.

Figure 1:
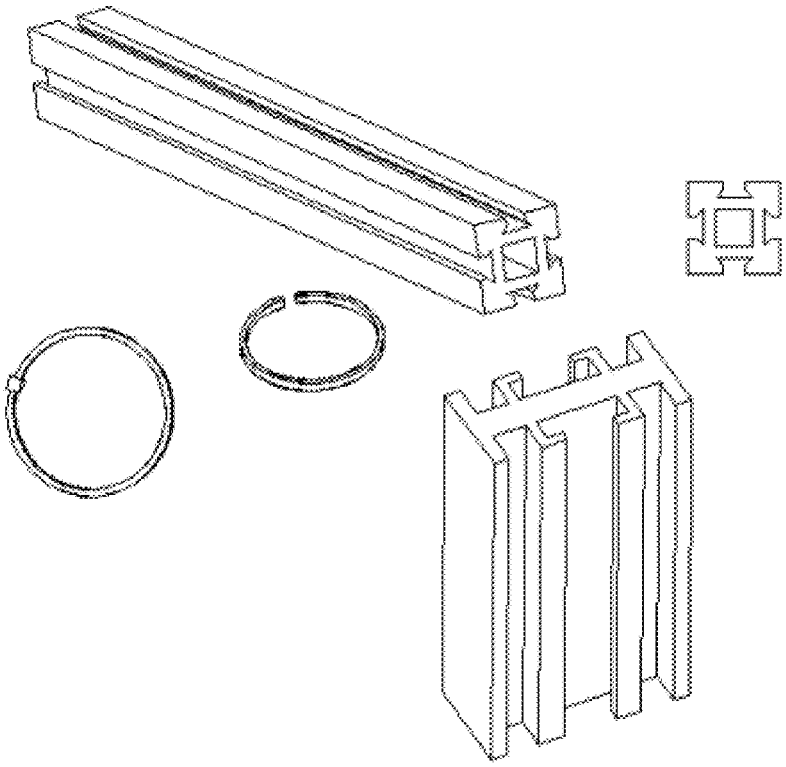
FIG. 1 is the schematic diagram of the frame member module.

As shown in FIG. 1, the frame member module includes a frame member. The frame member includes a cylindrical plastic metal composite part A and a snap-in connecting part. The outer layer of the cylindrical plastic metal composite part A is plastic, and the core is a metal strip. Each side surface of the cylindrical plastic metal composite part A has a T-shaped groove. As shown in FIG. 1, which is an entire structural schematic diagram of the frame members, regarding the cylindrical plastic metal composite part, the tetrahedral cylinder is taken as an example but is not limited thereto. In practice, a triangular prism, a quadrangular prism, or a pentagonal prism can be used. That is, the following structure is used, i.e., the number of the side surfaces of the cylindrical plastic metal composite part is N, wherein N is an integer which is equal to or greater than 3. FIG. 1 further shows the corresponding cross-sectional diagram and an annular frame member consisting of the cylindrical plastic metal composite part and the snap-in connecting part.

Figure 2:
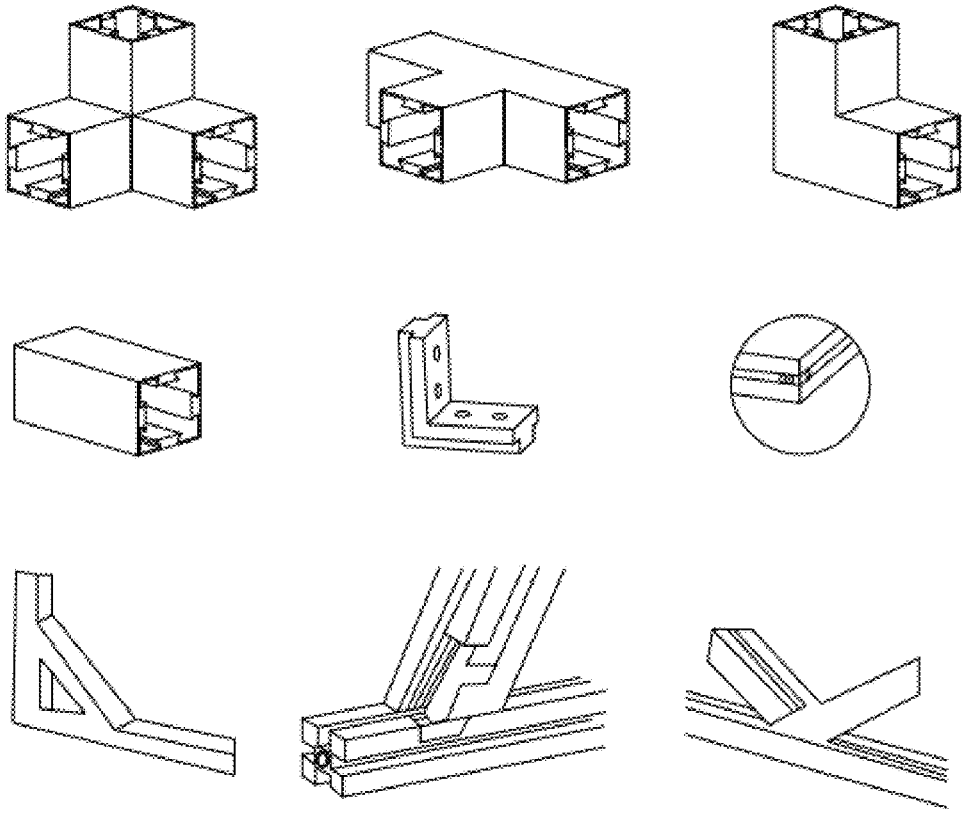
FIG. 2 is the structural schematic diagram of a snap-in connecting part with different structures of the frame member module.

FIG. 2 shows the schematic diagram of some snap-in connecting parts, which are merely for exemplary description. In the art, the following part can be used, i.e., a snap-in connecting part with a corresponding structure which can snap in the T-shaped groove structure to achieve the snapping-in of the two parts, so as to achieve the frame members with different structures.

Figure 3:
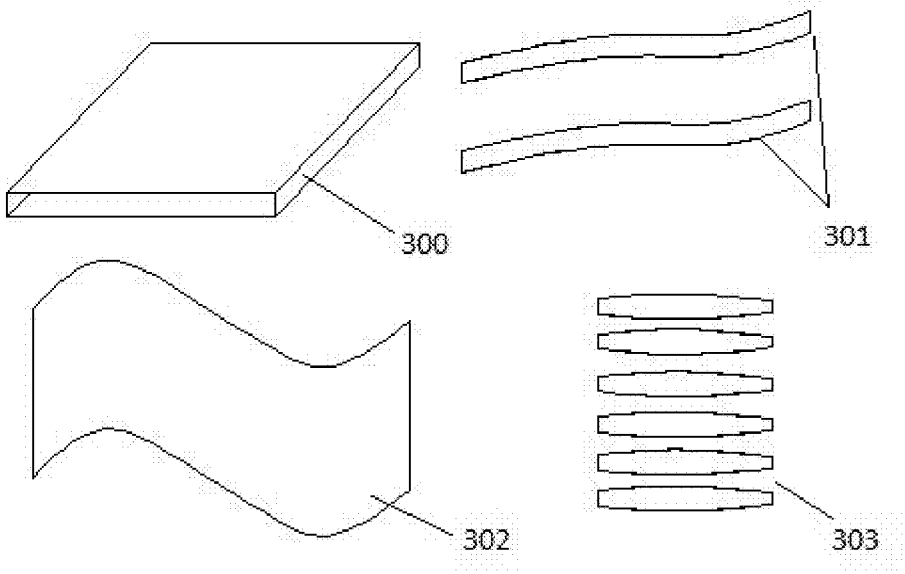
FIG. 3 is the schematic diagram of the housing supporting and molding member module.

As shown in FIG. 3, the housing supporting and molding member module includes a supporting and molding member. The supporting and molding member has a multilayer piece-like structure. The number of layers is N. N is an odd number which is equal to or greater than 3. From top to bottom, the multilayer structure is arranged in an order of one plastic layer and one metal layer in an alternate manner. The uppermost layer and the lowermost layer are plastic layers. The mechanical strength of the supporting and molding member is configured in such a way that the supporting and molding member can be arbitrarily bent or tailored by manpower to form the supporting member of the housing of the lamp, the cover, or the flexible film material of the lamp.

FIG. 3 shows a typical three-layered supporting and molding member. The interlayer is a metal strip, a metal sheet, or a metal net. The upper and lower layers are coated with plastic respectively. The color of plastic can be determined flexibly based on actual needs. The supporting and molding member can be bent, fixed, and tailored (typical and general scissors) by manpower. For example, in FIG. 3, the supporting and molding member which is planar 300 at first is cut into strips 301,302 and further bent into annular shape 303.

Figure 4:
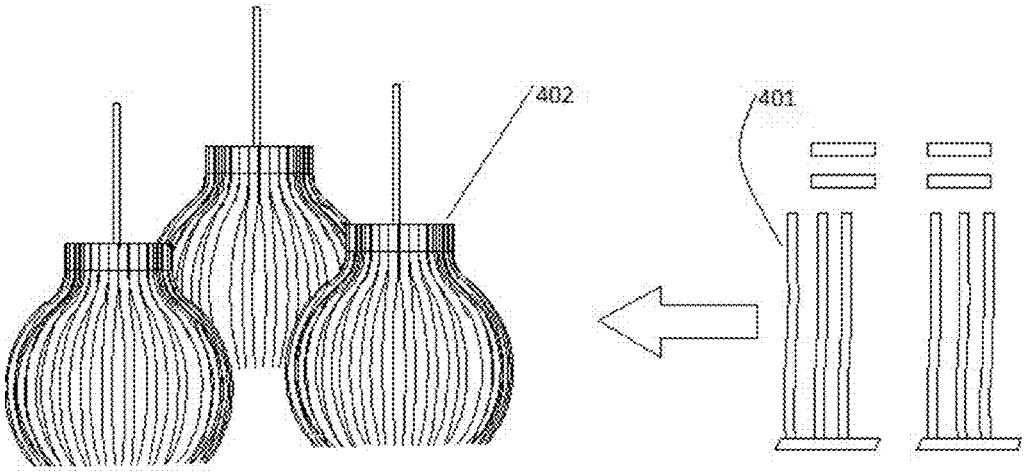
FIG. 4 is the structural schematic diagram of the onion-shaped housing formed by the housing supporting and molding member module.

FIG. 4 shows that the supporting and molding member is cut into strips 401. The strips can form a housing or cover of the lamp in an onion shape 402. The above descriptions are merely exemplary. In the art, housing or cover with different structures, shapes, and appearances can be made based on ordinary measures in the art.

Figure 5:
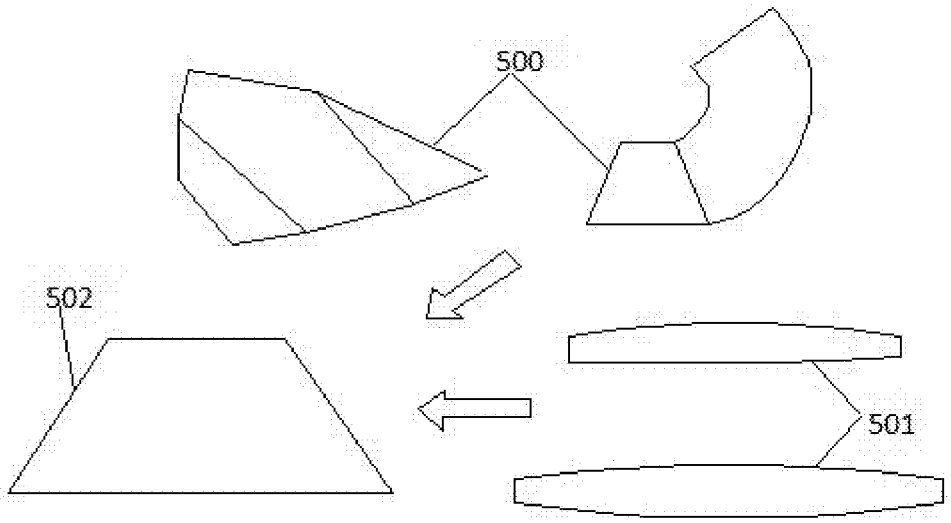
FIG. 5 is the schematic diagram of the snap-in connection of the piece-like module of the light cover film cloth and the frame member.

FIG. 5 shows that the cloth of lamp cover is cut into sectors 500. The sectors are aligned and adhered to form a circular truncated cone 502. Annular supporting and molding members 501 are provided on the upper and lower openings of the circular truncated cone, so as to form a housing or cover of the LED lamp in a circular truncated cone shape.

Figure 6:
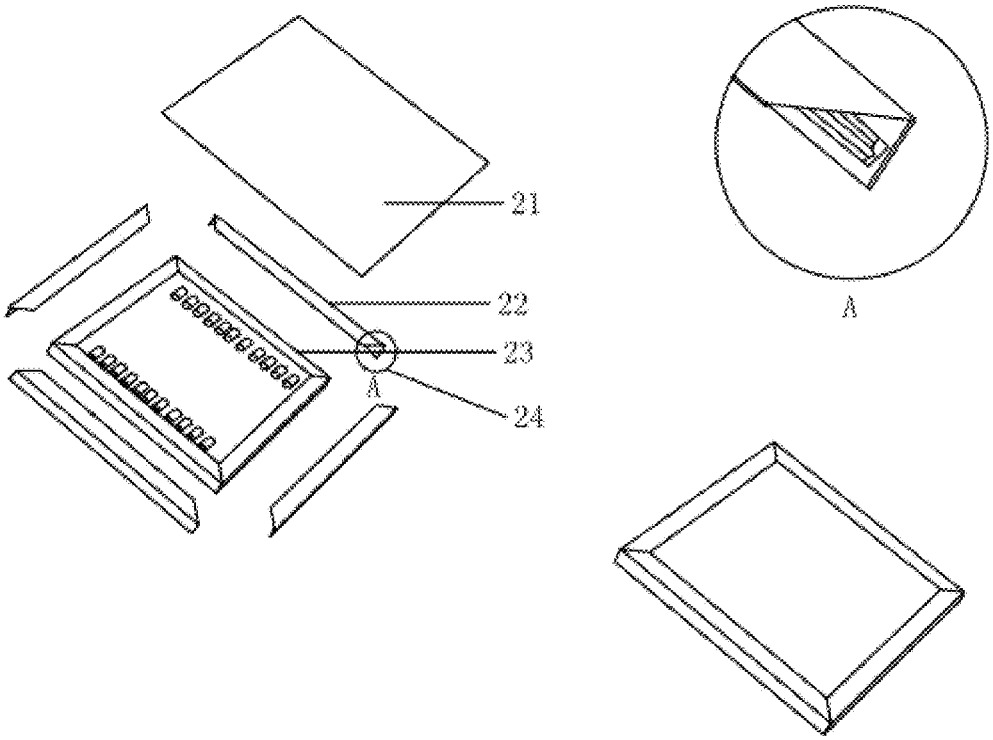
FIG. 6 is the structural schematic diagram of the decorative fastening member module.

FIG. 6 shows the decorative fastening member module, which includes cylindrical plastic metal composite part B, a H-shaped snap-in connecting part, and a L-shaped or U-shaped fastening sealing strip with a snap joint. With a quadrangular LED lamp formed by four cylindrical plastic metal composite parts 23 as an example, further descriptions are as follows. Four cylindrical plastic metal composite parts 23 form the frame of the quadrangular LED lamp. L-shaped fastening sealing strips 22 with a snap joint are used. Snap joint 24 is provided on an internal side of each L-shaped fastening sealing strip 22. Snap joint 24 snaps in T-shaped groove of cylindrical plastic metal composite part 23 to play roles of snap-in fastening and sealing. Film 21 is provided on the light-exiting surface of the LED lamp to play the role of transmitting the light and protecting the internal LED light source. It should be noted that, in order to differentiate the cylindrical plastic metal composite part included in the frame member and the cylindrical plastic metal composite part included in the decorative fastening member module, the cylindrical plastic metal composite part included in the frame member is defined as cylindrical plastic metal composite part A, and the cylindrical plastic metal composite part included in the decorative fastening member module is defined as cylindrical plastic metal composite part B, respectively. In the art, with regard to the present application, cylindrical plastic metal composite parts A and B may have the same or different structures.

Figure 7:
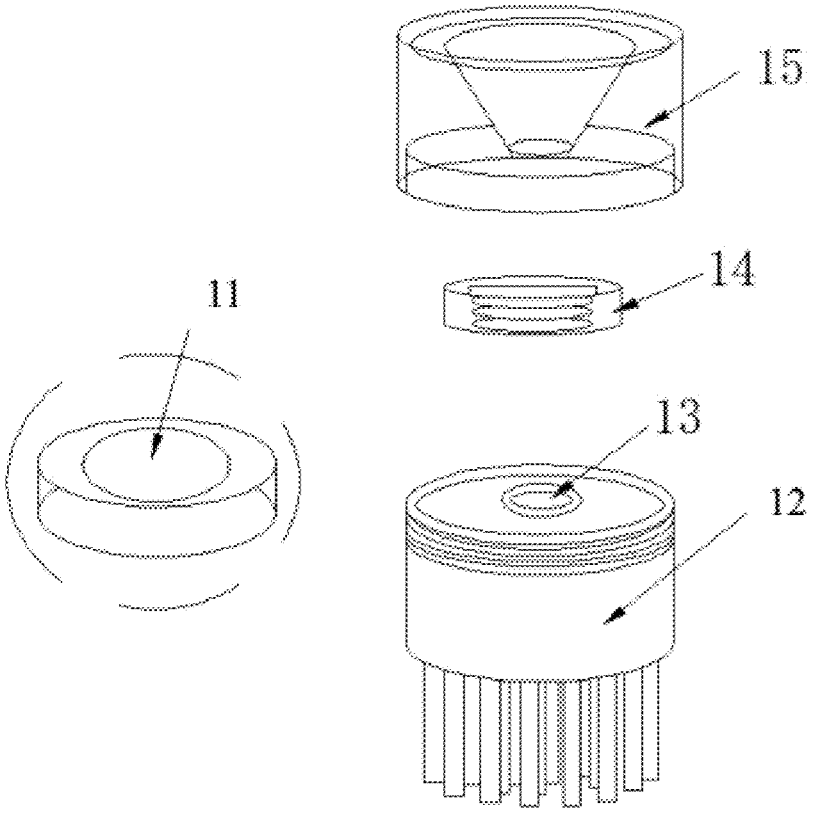
FIG. 7 is the structural schematic diagram of screw-in lens and decorative lighting module in which the lens and decorative lighting can be replaced arbitrarily.

As shown in FIG. 7, the screw-in lens and decorative lighting module includes screw-in secondary light distribution lens. The outer wall of the secondary light distribution lens and the plug-in integrated light source module are fixed to each other in a screw-in manner. In order to clearly describe the above screw-in lens and decorative lighting module, two types of LED lamps are taken as examples. The LED lamp includes LED chip-heat sink integrated lamp bead 12. The center portion of the upper surface of the integrated lamp bead 12 is provided with chip illuminating cup cavity 13. Chip 11 is fixed on the metal surface inside chip illuminating cup cavity 13. The chip is connected to positive and negative poles of the circuit and is packaged by adhesive dispensing. The cup cavity wall of chip illuminating cup cavity 13 is a circular plastic part or metal part. The internal wall of the chip illuminating cup cavity 13 has an oblique angle. The outer wall of chip illuminating cup cavity 13 has a right-angled threaded shape.

The LED lamp further includes ring 14 which can be fixed to and detached from the outer wall of chip illuminating cup cavity 13 in a screw-in manner. Ring 14 is metal or opaque plastic material. The center of ring 14 includes a hole. The diameter of the hole is the same as the external diameter of chip illuminating cup cavity 13. The upper portions of the holes are provided with a plastic lens. The lower portion of the ring is provided with female threads. The female threads can screw with the male threads of the cup cavity correspondingly, such that lens and chip illuminating cup cavity 13 are attached to each other closely. A layer of transparent silicon resin paste is applied between the lens and chip packaging adhesive layer, such that the luminous efficacy can be improved. At the same time, lens and chip illuminating cup cavity 13 attach to each other seamlessly. The light emitted from chip 11 exits through the lens in the center of ring 14 and stimulates the fluorescent powder therein to emit the light with desired color temperature and chromatograph. The LED lamp further includes secondary light distribution lens 15. Secondary light distribution lens 15 may have any form, shape, or beam angle. Secondary light distribution lens 15 closely attaches to the lens at the center of ring 14. The internal side of the outer wall of secondary light distribution lens 15 is fixed to integrated lamp bead 12 in a screw-in manner.

Figure 8:
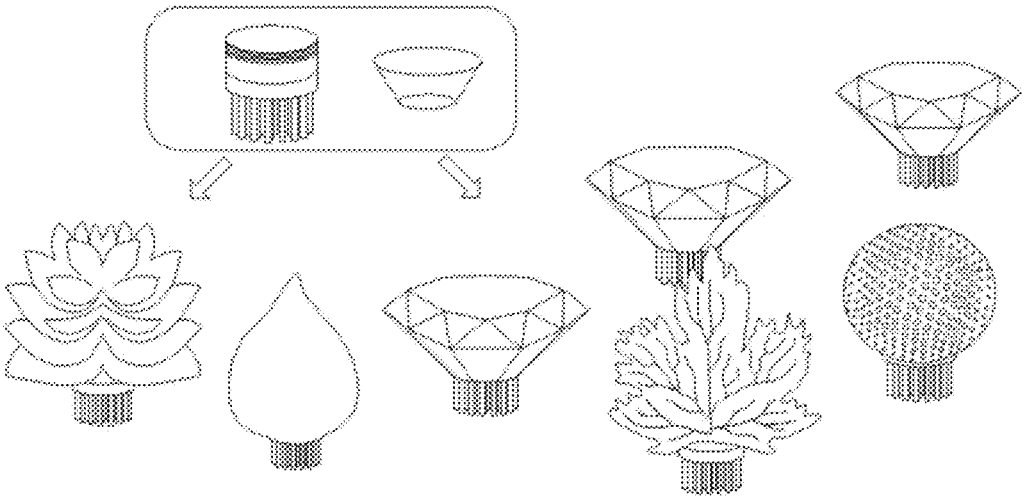
FIG. 8 is the structural schematic diagram of the lens and decorative lighting module with different appearances and structures.

FIG. 8 shows lens and decorative lighting modules with different appearances and structures, such as lotus, peach, leaf, and diamond shape.

Figure 9:
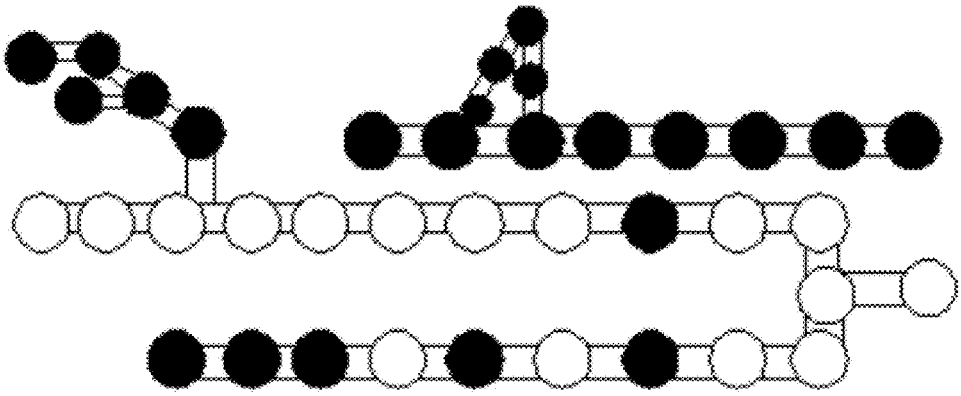
FIG. 9 is the structural schematic diagram of the plug-in three-dimensional circuit connector module that can be arbitrarily bent and fixed.

As shown in FIG. 9, the above plug-in three-dimensional circuit connector module which can be arbitrarily bent and fixed includes a three-dimensional circuit. The above three-dimensional circuit is connected through three-dimensional circuit connectors. The circuit connector includes a plurality of connecting units that have connecting points and can be arbitrarily bent and fixed. The connecting units that can be arbitrarily bent and fixed are connected to each other through connecting points. The connecting points of interconnected connecting units that can be arbitrarily bent and fixed are connected to each other correspondingly. The three-dimensional circuit connector includes a male plug connecting unit and a female plug connecting unit. The male plug connecting unit includes a male plug terminal connector and a series-parallel converting terminal. The female plug connecting unit includes a female plug terminal connector and an adaptor female plug terminal (not shown in FIG. 9).

Figure 10:
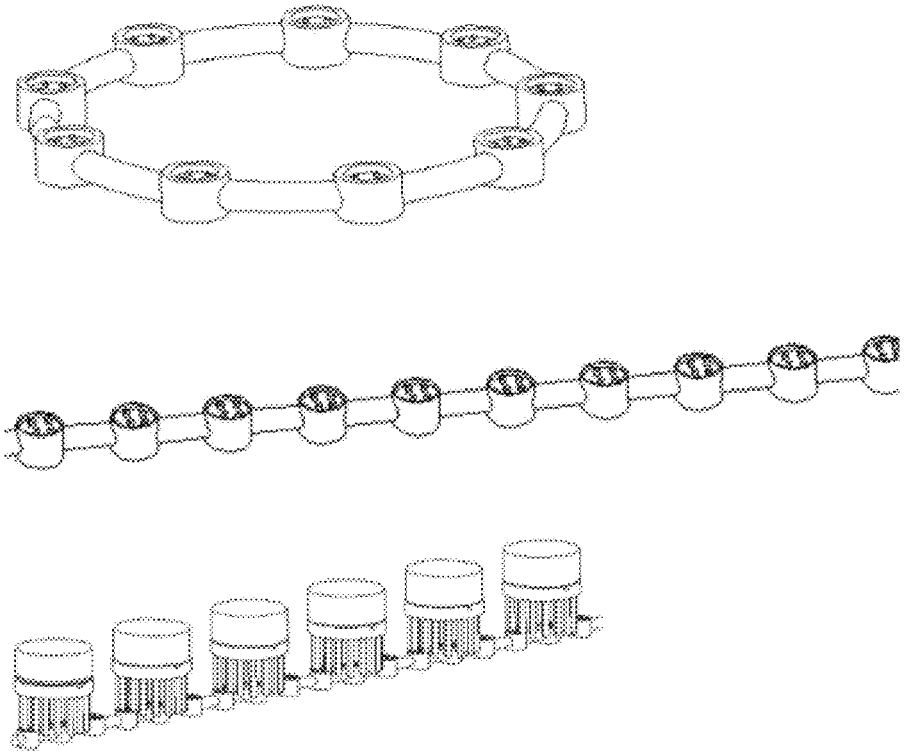
FIG. 10 is the schematic diagram of annular and linear structures formed by the plug-in three-dimensional circuit connector modules and can be arbitrarily bent and fixed.

FIG. 10 further shows annular and linear structures formed by plug-in three-dimensional circuit connector modules, which can be arbitrarily bent and fixed.

Figure 11:
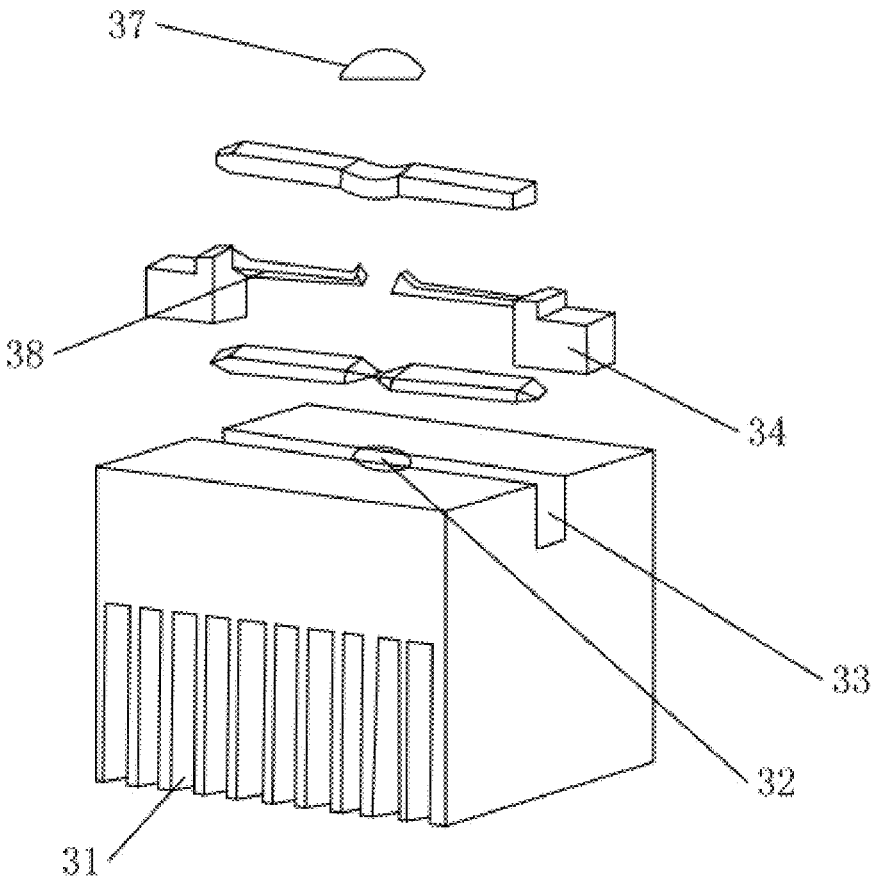
FIG. 11 is the schematic diagram of the plug-in integrated light source module.

FIG. 11 further describes the plug-in integrated light source module in detail with the cuboid lamp bead as an example. A plurality of cuboid lamp beads and modular light bars are provided, and the cuboid lamp beads are molded through a single process. Specifically, the process is die casting. The cuboid lamp beads are plugged in the modular light bars. The number of lamp beads can be increased or decreased and can be adjusted based on actual power. A projecting lamp cup 32 is formed by injection molding at the geometric center of the upper surface of the lamp bead body. The lamp cup 32 is an inversed flat-topped quadrangular pyramid groove. Lamp cup 32 is provided with an LED chip. Lens 37 is provided in the illuminating optical path of LED and plays the role of diffusion of rays. The upper surface of the lamp bead body is further provided with two grooves 33. Two grooves 33 are positioned on both sides of lamp cup 32 and correspond to each other. Grooves 33 are provided with positive and negative pole circuits 38. Positive and negative pole circuits 38 of the lamp bead are wrapped within the grooves by injection molding to achieve insulation. One end of each of positive and negative pole circuits 38 is connected to the LED chip, while the other end is exposed to the outside of the groove, so that positive and negative poles are formed on both sides of the lamp bead. Male plugs 34 of male and female plug structure are formed on both sides of the lamp bead where positive and negative poles are located by injection molding. The ends of positive and negative pole circuits 38, which are exposed to the outside of the grooves, are positioned in male plugs 34. The lower part of the lamp bead body is configured to be heat dissipation plates 31.

Figure 12:
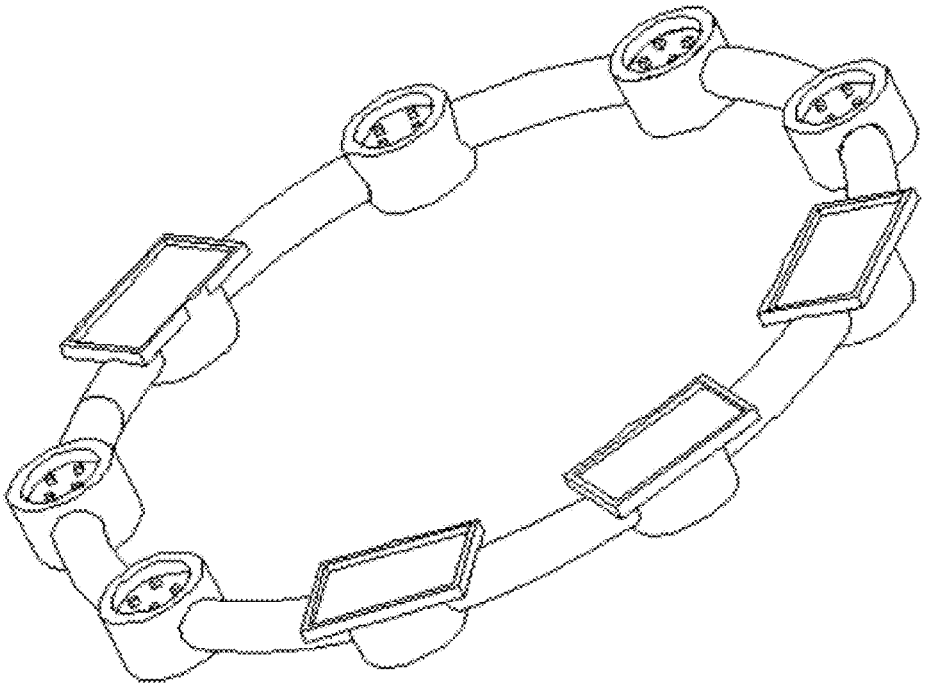
FIG. 12 is the structural schematic diagram in which the plug-in power supply module fits the annular three-dimensional circuit.
Figure 13:
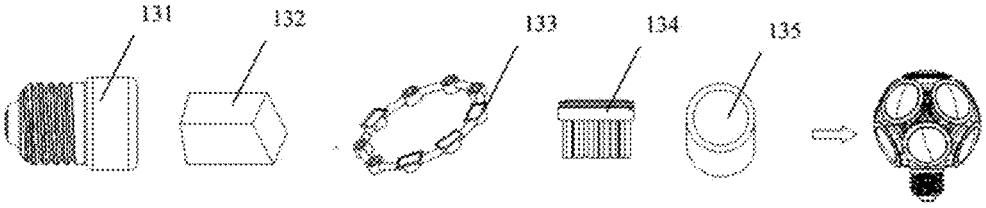
FIGS. 13-16 are the structural schematic diagrams of different types of LED illuminating device assembly, such as spherical type, planar type, and candle type.
Figure 14:
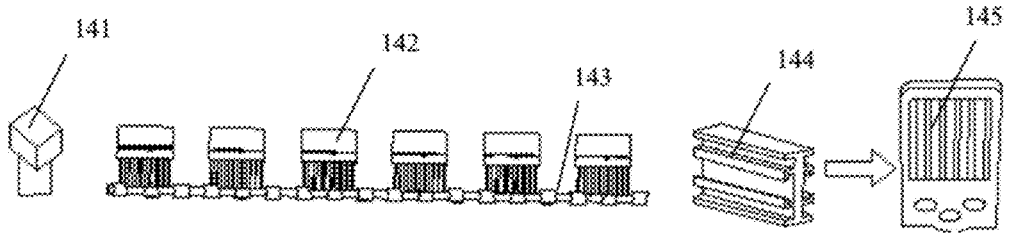
Figure 15:
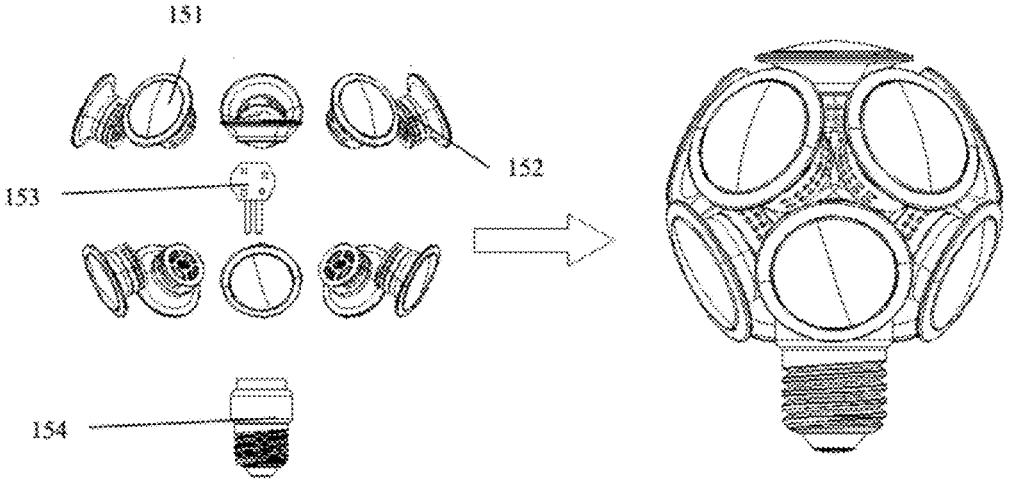
Figure 16:
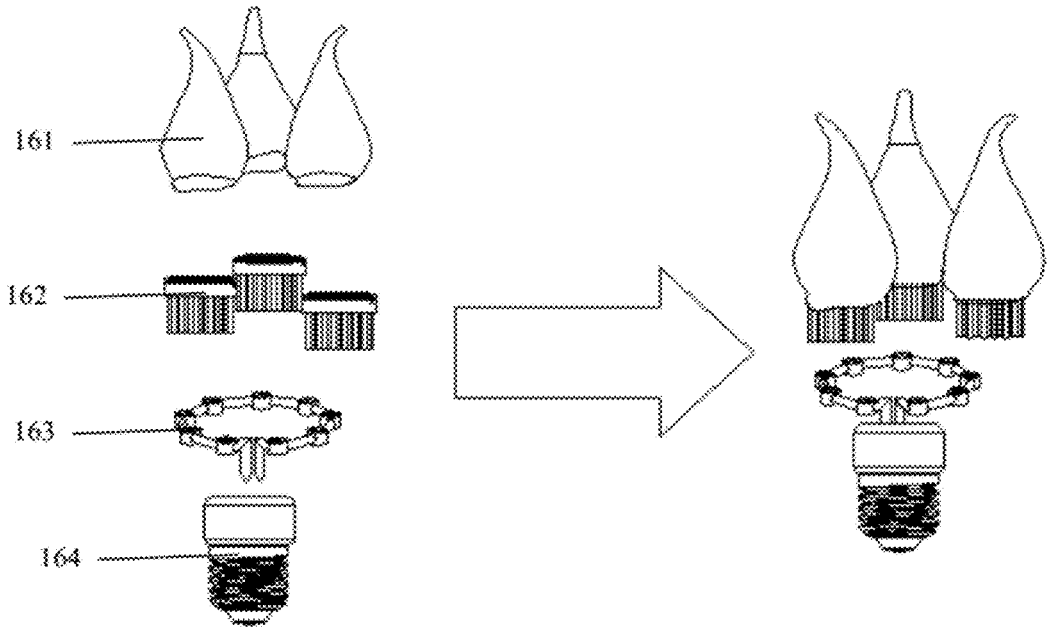

FIG. 12 is the structural schematic diagram in which plug-in power supply module fits annular three-dimensional circuit. In order to realize intellectual control, power matching, EMC, etc., a plurality of different standardized plug-in power supply modules are used. The modules are matched and replaced by plugging in. The adaptive scope of the product is further improved to meet personal demands of the consumer.

FIGS. 13-16 are different types of LED illuminating devices, such as spherical, planar, or candle types. It should be noted that the above FIGS. 13-16 are only illustrative. Rather, the corresponding LED illumination is not limited to include all the modules defined in the claims. In the figures, reference numbers are as below:

131—lamp head base, 132—circuit connecting module, 133—lamp head base, 134—light source module, 135—decorative lighting lens module;

141—power supply module, 142—light source module, 143—three-dimensional circuit connecting module, 144—frame module, 145—whole lamp;

151—decorative lighting lens module, 152—light source module, 153—connector module, 154—power supply module;

161—decorative lighting lens module, 162—light source module, 163—connector module, 164—power supply module.

Based on further descriptions of the above specific embodiments, an LED illuminating device with the arbitrary bending and fixing connector module disclosed by the present invention includes a lamp cover, a housing, and a base, wherein the lamp cover, the housing, and the base are formed in a standardized general modularized manner, and can be combined to form the desired appearance of the illuminating device. Also, a lens decorative lighting member that uses a general screw-in manner is included. The lens decorative lighting member can act as both decorative lighting and lens. The elected lens decorative lighting member can change the light emitting angle and the color temperature arbitrarily. A plug-in integrated light source module consisting of a lamp bead and a heat sink is further included. A plug-in three-dimensional circuit connecting component, which replaces the existing PCB, is further included to form a general component, which can be arbitrarily bent, fixed, and tailored. A plug-in power supply module is further included, wherein additional functions can be arbitrarily selected and replaced based on demands. Thus, the new LED illuminating device with the arbitrary bending and fixing connector module can be realized with modularization, standardization, and diversification.

The above descriptions are only preferred embodiments of the present invention. It should be noted that, for a person of ordinary skill in the art, without departing from the technical principle of the present invention, a plurality of further improvements and variations can be made. Such improvements and variations fall within the protective scope of the present invention.

Embodiment 2

Main differences between the present embodiment and Embodiment 1 are as follows. The plug-in integrated light source module is an LED lamp with remote fluorescent powder structure in which the color temperature of the light source can be adjusted.

The LED lamp with remote fluorescent powder structure in which the color temperature of the light source can be adjusted includes a LED chip and heat sink integrated lamp bead consisting of a lamp bead body, an LED chip, and a circuit.

Figure 17:
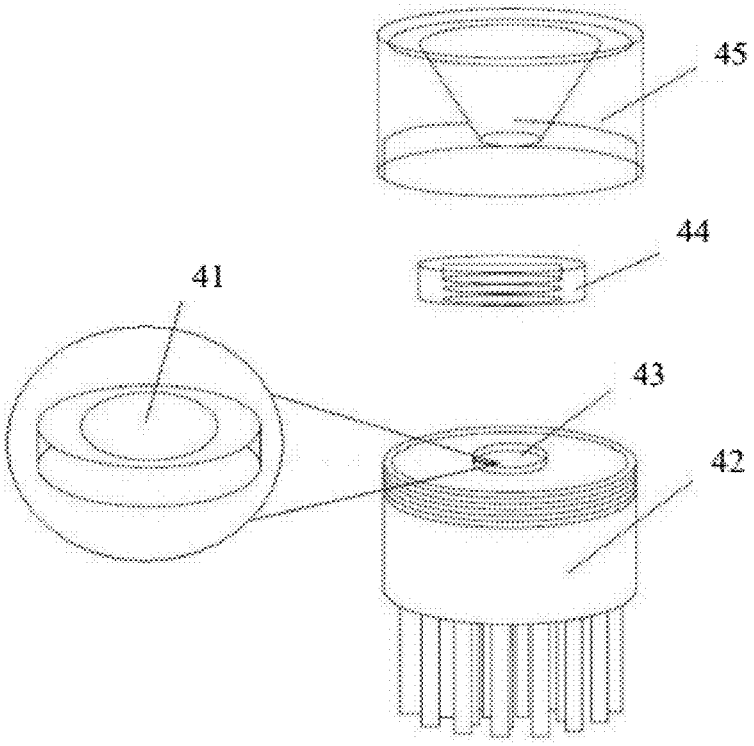
FIG. 17 is the schematic diagram of the plug-in integrated light source module in Embodiment 2.

As shown in FIG. 17, the center portion of the upper surface of integrated lamp bead 42 is provided with chip illuminating cup cavity 43. Chip 41 is fixed on the metal surface inside chip illuminating cup cavity 43. The chip is connected to positive and negative poles of the circuit and is packaged by adhesive dispensing. The cup cavity wall of chip illuminating cup cavity 43 is a circular plastic part or metal part. The internal wall of the chip illuminating cup cavity 43 has an oblique angle. The outer wall of chip illuminating cup cavity 43 has a right-angled threaded shape.

Figure 18:
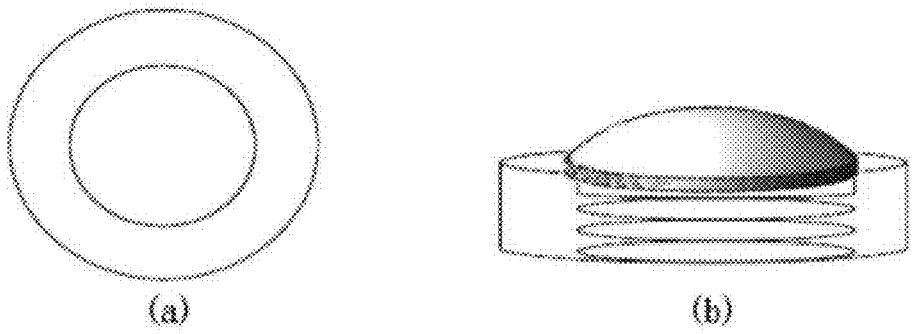
FIG. 18 (*a*) is the top view of the plastic fluorescent lens which is arc lens in Embodiment 2.
Figure 19:
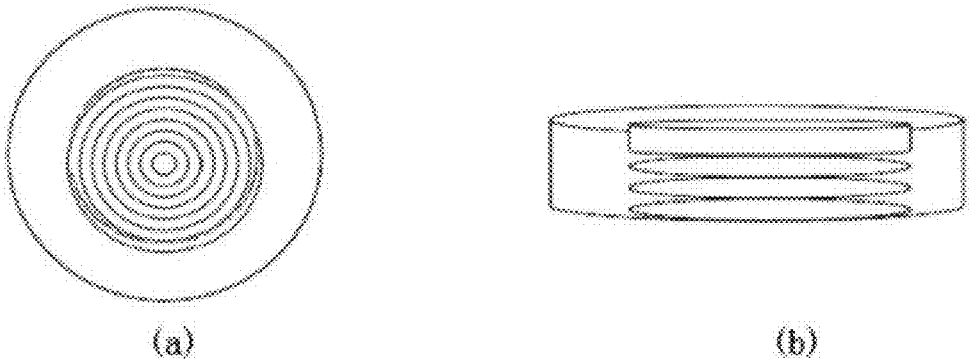
FIG. 19 (*a*) is the top view of the plastic fluorescent lens which is Fresnel lens in Embodiment 2.

Ring 44, which can be fixed to and detached from the outer wall of chip illuminating cup cavity 43 in a screw-in manner is included. Ring 44 is made of metal or opaque plastic material. The center of ring 44 has a hole. The diameter of the hole is the same as the external diameter of the chip illuminating cup cavity 43. The upper portion of the hole is provided with a plastic lens. Referring to FIG. 18 and FIG. 19, the plastic lens is Fresnel planar lens or lens of other forms. The plastic lens is a plastic fluorescent lens. The lens and fluorescent powder are formed as a whole uniformly by injection molding process. Meanwhile, the lens and ring 44 are also fixed on the upper portion of the hole by injection molding process.

The lower portion of the ring is provided with female threads. The female threads can screw with the male threads of the cup cavity correspondingly, such that lens and chip illuminating cup cavity 43 are attached to each other closely. A layer of transparent silicon resin paste is applied between the lens and chip packaging adhesive layer, such that the luminous efficacy can be improved. At the same time, lens and chip illuminating cup cavity 43 seamlessly attach to each other. The light emitted from chip 41 exits through the lens in the center of ring 44 and stimulates the fluorescent powder therein to emit the light with desired color temperature and chromatograph.

Secondary light distribution lens 55 and plastic fluorescent lens attach to each other closely. Secondary light distribution lens 55 may have any form, shape, or beam angle. Secondary light distribution lens 55 closely attaches to the lens at the center of ring 44. The internal side of the outer wall of secondary light distribution lens 55 is fixed to integrated lamp bead 42 in a screw-in manner.

Moreover, the plastic fluorescent lens includes a bluish white light lens, a true white light lens, and a yellowish white light lens.

The formula of the bluish white light lens is white light paste:curing agent:bluish white light fluorescent powder=1:1:(0.07-0.09).

The formula of the true white light lens is white light paste:curing agent:true white light fluorescent powder=1:1:(0.085-0.12).

The formula of the yellowish white light lens is white light solution:B curing agent:yellowish white light fluorescent powder=1:1:(0.11-0.15).

The rest parts of the present embodiment are the same as those in Embodiment 1.

Embodiment 3

Main differences between the present embodiment and Embodiment 1 are as follows. The plug-in integrated light source module is a LED light source module, which directly uses the metal heat sink as positive and negative pole circuits.

The metal body A is formed by n little metal bodies B that are of the same or different shapes, and the little metal bodies B are electrically insulative from each other and fixedly connected to each other, wherein n>=2. The surface of each little metal body B is provided with m LED chips with the same or different number, wherein m>=1. Adjacent LED chips are connected to each other in series or in parallel. Each little metal body B is provided with a plurality of circuit connecting points, so as to form the circuit. Except for the circuit connecting points, the surface of the little metal body B is insulative. The LED chips are directly adhered or fixed to the little metal body B by welding. At the same time, silica gel covers the chips and the connecting circuit. Based on the design requirements of the entire circuit, each little metal body B can be designed to have a plurality of positive poles or negative poles. The plurality of positive poles or negative poles can be connected to the chips on the little metal body B in series or in parallel or in hybrid serial-parallel manner. Also, the plurality of positive poles or negative poles can be connected to positive poles or negative poles on other little metal bodies. Moreover, the plurality of positive poles or negative poles can be connected to the external circuit to form a whole desired circuit. The metal body A formed by a plurality of little metal bodies B is used as the heat sink of the LED light source module and further as the positive and negative pole circuits of the LED light source module.

Figure 20:
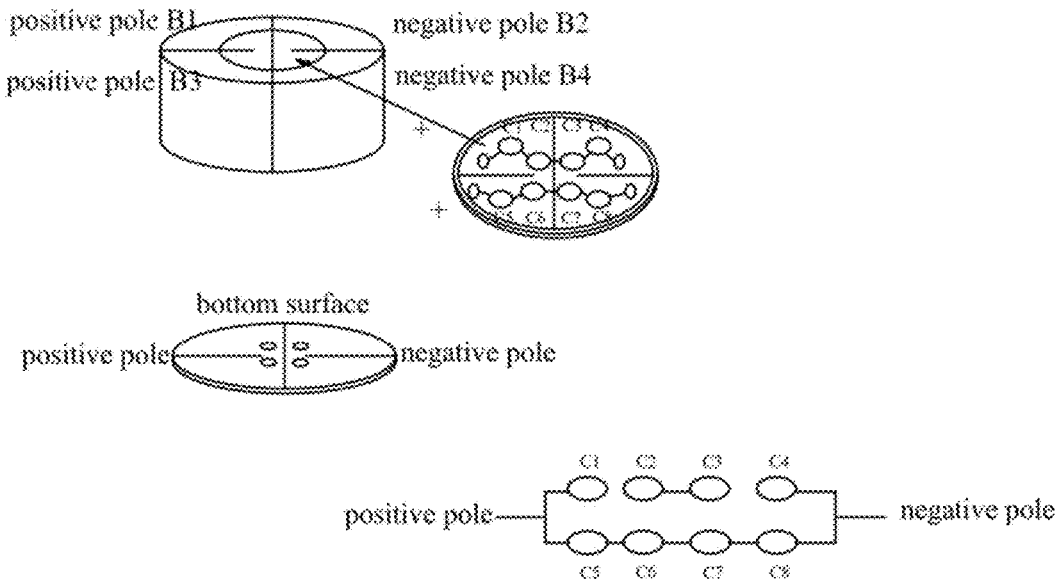
FIG. 20 is the functional schematic diagram of the plug-in integrated light source module in Embodiment 3.
Figure 21:
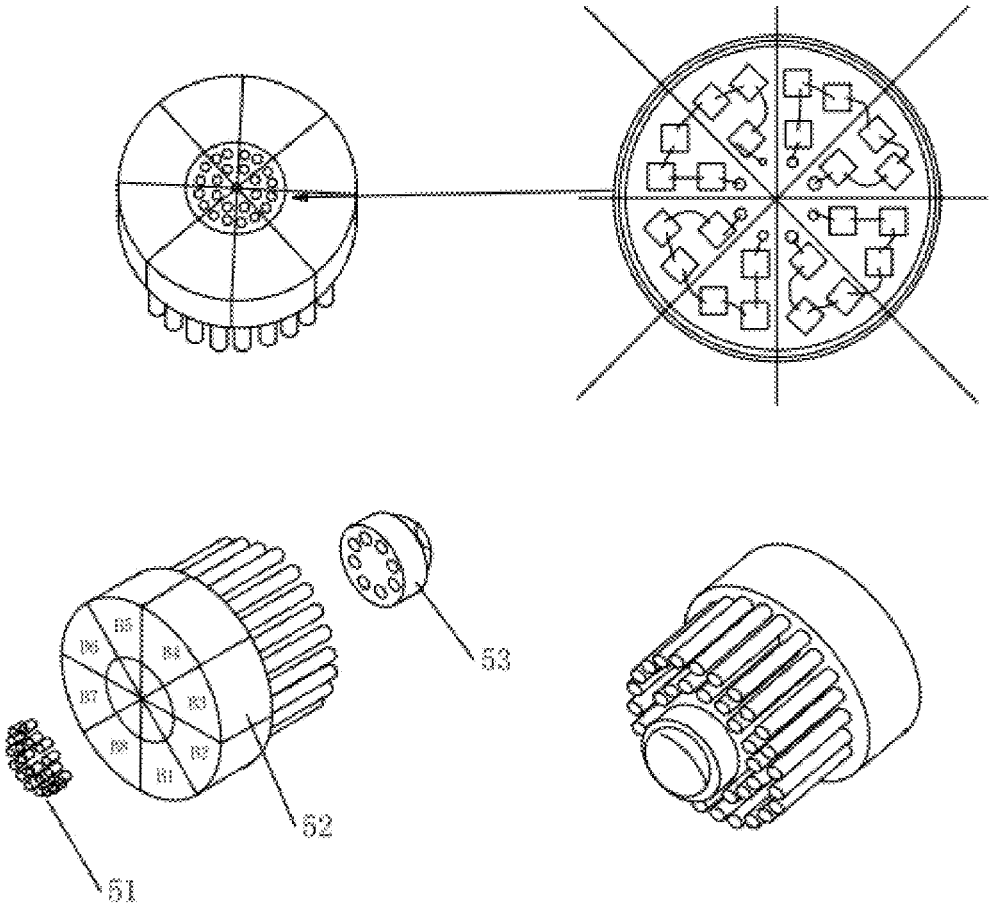
FIG. 21 is the structural diagram of the plug-in integrated light source module in which a cylindrical metal body A made up by 8 little metal bodies B is taken as an example of Embodiment 3.

Specifically, as shown in FIG. 20 and FIG. 21, in the LED light source module which directly uses the metal heat sink as positive and negative pole circuits, the lamp bead body is metal body A.

Metal body A can be regular or irregular shapes and is formed by n little metal bodies B (B1 • • • Bn) that are of the same or different shapes, and the little metal bodies B are insulative of each other and fixedly connected to each other.

The surface of each little metal body B is provided with a plurality of LED chips C (C1 • • • Cn) with the same or different number. Adjacent chips are connected to each other in series or in parallel.

Each little metal body B is provided with a plurality of circuit connecting points. Except for circuit connecting points, the surface of the little metal body is insulative.

Chips C are directly adhered or fixed to the little metal body B by welding. At the same time, silica gel covers the chips and the connecting circuit.

Based on the design requirements of the entire circuit, each little metal body B can be designed to have a plurality of positive poles or negative poles. The plurality of positive poles or negative poles can be connected to the chips on the little metal body B in series or in parallel. Also, the plurality of positive poles or negative poles can be connected to positive poles or negative poles of other little metal bodies. Moreover, the plurality of positive poles or negative poles can be connected to the external circuit to form a whole desired circuit.

As shown in FIG. 20, four little metal bodies B form the cylindrical metal body A. LED chips c1, c2 are provided on the little metal body B1. LED chips c3, c4 are provided on little metal body B2. LED chips c5, c6 are provided on little metal body B3. LED chips c7, c8 are provided on little metal body B4. LED chips c1, c2, c3, c4 are connected in series to form a first string. LED chips c5, c6, c7, c8 are connected in series to form a second string. Next, the first string and the second string are connected in parallel to form a third string. Two ends of the third string act as the positive pole and the negative pole respectively. The top surface of the metal body A is provided with positive pole B1, negative pole B2, positive pole B3, and negative pole B4, respectively. The bottom surface of the metal body A is provided with two pairs of positive and negative poles correspondingly.

No matter whether all the chips on the formed large metal body A are connected in full series, full parallel, series-parallel, or parallel-series, the number of chips in each series or parallel circuit finally formed is symmetrical and uniform, so as to ensure the uniformity of the emitting light. Of course, in order to meet the actual demand, under the condition that the power supply meets the normal working of the LED chips, the asymmetrical and nonuniform arrangement can also be used.

As shown in FIG. 21, LED chips 51, eight little metal bodies B52, and fixing or circuit connecting position 53 are combined in a way similar to that shown in FIG. 20 to form a cylindrical metal body A. In order to further improve the heat dissipation efficiency, a plurality of heat dissipation columns (not shown by a reference number) can be additionally provided.

The rest parts of the present embodiment are the same as those in Embodiment 1.

Embodiment 4

Main differences between the present embodiment and Embodiment 1 are as follows. The plug-in integrated light source module is a plug-in LED chip and heat sink integrated light source and lens structure.

In the plug-in LED chip and heat sink integrated light source and lens structure, the lamp bead body is a metal body. The metal body is provided with the chip and cup cavity. The cup cavity is provided with positive and negative poles. The positive and negative pins corresponding to the positive and negative poles form a male plug by injection molding to reach the heat dissipation structure. The male plug is connected to an external female plug, so as to turn on the circuit. The upper portion of the cup cavity is provided with a lens. The external diameter of the lens is the same as that of the cup cavity. The lens and the central hole of the metal piece are connected and integrated as a whole by injection molding, which is screwed on the cup cavity. A metal part is further included. The secondary light distribution lens and the metal part are fixed together as a whole by injection molding or in a snap-in manner. The joint surface between the secondary light distribution lens and the metal part is subject to a reflective process. The light that is refracted by the lens can be reflected effectively. The bottom of the metal part is provided with threads and plastic gasket. The metal part is fixed to the metal body through threads in a screw-in manner.

Figure 22:
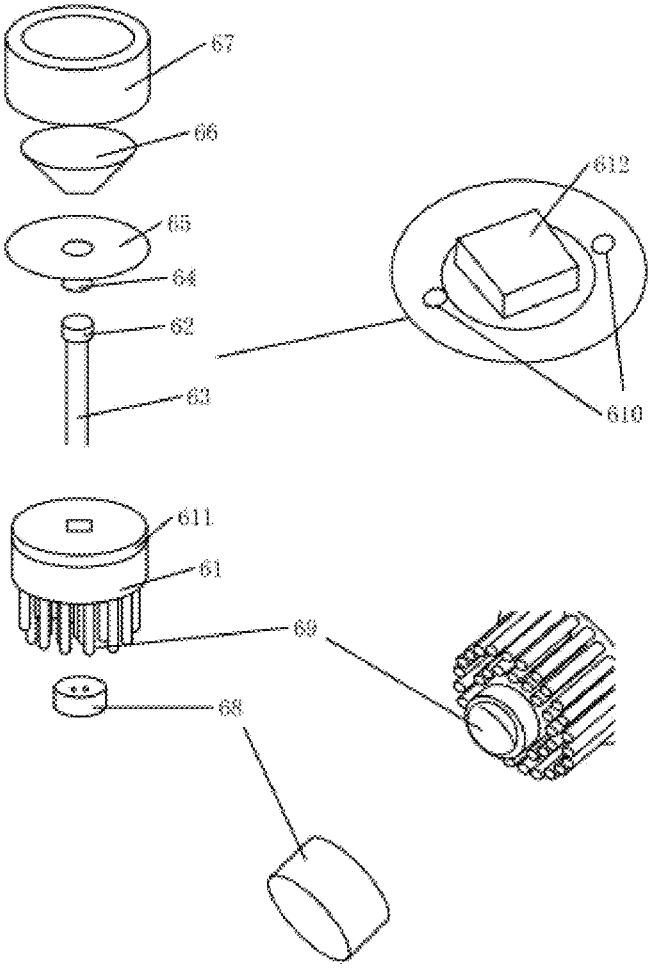
FIG. 22 is the structural explosive diagram of the plug-in integrated light source module in Embodiment 4.
Figure 23:
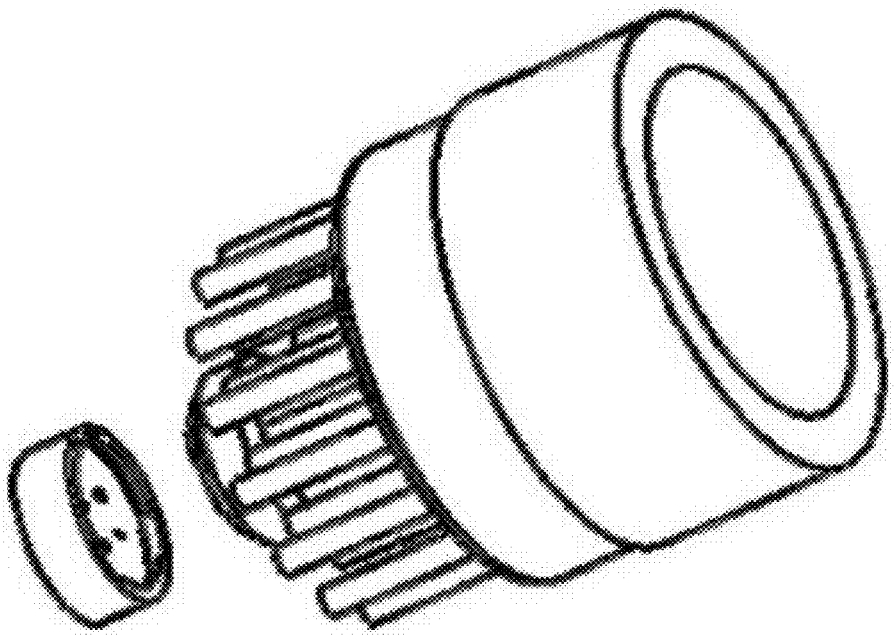
FIG. 23 is the schematic diagram of the plug-in integrated light source module in Embodiment 4.

Specifically, as shown in FIG. 22 and FIG. 23, LED chip and heat sink integrated light source and lens structure has a plug-in structure. Metal body 61 is provided with chip 612 and cup cavity 62. The cup cavity is provided with positive and negative poles 610. Positive and negative pins 63 corresponding to positive and negative poles 610 form a male plug 69 by injection molding to directly reach the bottom of the heat dissipation column. Male plug 69 is connected to external female plug 68, so as to turn on the circuit.

The upper portion of the cup cavity is provided with lens 64. The external diameter of the lens is the same as that of the chip cup cavity. Lens 64 can be transparent planar resin piece or curved sphere, which is doped with fluorescent powder therein. Lens 64 and the central hole of metal piece 65 are connected and integrated as a whole by injection molding, which is screwed on the chip cup cavity. The light emitted from the chip all exits through lens 64 to reach transparent secondary light distribution lens 66, so as to exit through secondary light distribution lens 66.

Metal part 67 is provided outside secondary light distribution lens 66, and secondary light distribution lens 66 is fixed to metal part 67 to form a whole by injection molding or in a snap-in manner. The joint surface between secondary light distribution lens 66 and metal part 67 is subject to a reflective process. The light that is refracted by the lens can be reflected effectively.

The bottom of metal part 67 is provided with threads and plastic gasket. Metal part 67 is fixed to metal body 61 through threads 611. Metal part 67 can play the role of heat-conducting and waterproof functions for metal body 61. The heat emitted from the LED chip can be completely dissipated through metal piece 65, metal part 67, metal body 61, and the heat dissipation columns, such that the heat dissipation efficiency is ensured.

Male plug 69 formed by injection molding is conductive at the terminal portion. The portion among heat dissipation columns is insulative to the heat dissipation columns. In order to further improve the insulative effect, the material that is electrically insulative and heat-dissipating efficient can be used as the material for the heat dissipation columns.

Male plug 69 can be configured to slightly project from the heat dissipation columns, so as to be electrically connected to female plug 68 in a plug-in manner. The structure of male plug 69 can be configured to be a structure matching any type of female plug based on demands.

Moreover, the heat dissipation columns can be replaced by heat dissipation wings or heat dissipation fins with regular or irregular structures.

The rest parts of the present embodiment are the same as those in Embodiment 1.

Embodiment 5

Main differences between the present embodiment and Embodiment 1, Embodiment 2, Embodiment 3 or Embodiment 4 are as follows. The plug-in three-dimensional circuit connector module, which can be arbitrarily bent and fixed, is a circuit connector.

Figure 24:
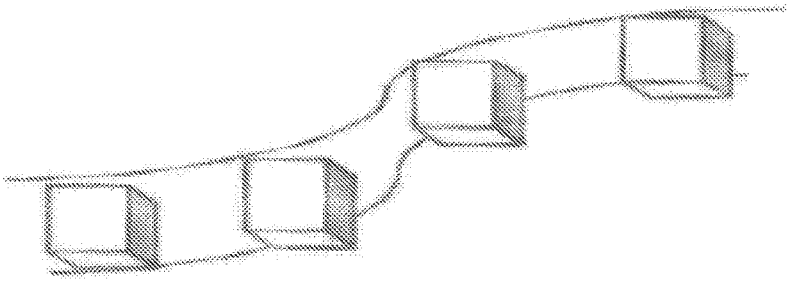
FIG. 24 is the structural schematic diagram of a flexible circuit board in Embodiment 5.
Figure 25:
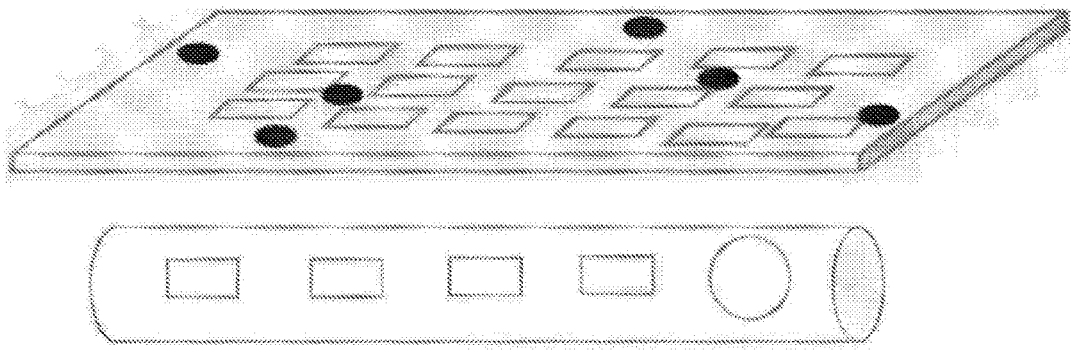
FIG. 25 is the schematic diagram of the fixing component in Embodiment 5.
Figure 26:
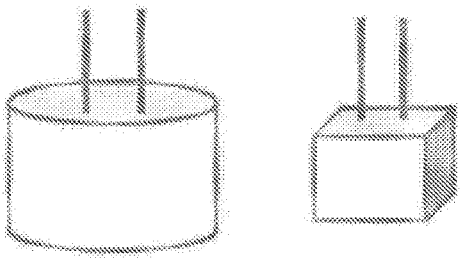
FIG. 26 is the structural schematic diagram of the discrete electronic device in Embodiment 5.

As shown in FIG. 24, FIG. 25, and FIG. 26, the circuit connector includes a flexible circuit board and a piece-like or cavity-shaped fixing component that can be arbitrarily bent and fixed. The flexible circuit board includes a flexible circuit and a plurality of male plugs or female plugs fixed thereto. The plug of the male plug or female plug is provided with a plurality of circuit plug-in points or welding points. The surface of the fixing component is provided with through opening or non-through local concave point or concave surface. The surface of the fixing component is also provided with a plurality of location holes. The flexible circuit board and the electronic devices provided on the flexible circuit board can be mounted and fixed in the through opening or on the non-through local concave point or concave surface of the component. The size of the male plug or female plug corresponds to the location of the opening, concave point, or concave surface on the surface of the component. Thus, the flexible circuit board and discrete electronic devices or modular devices provided thereon are completely attached to or snapped in on the surface of the above fixing component. Also, the flexible circuit board and discrete electronic devices or modular devices provided thereon can be directly positioned in the opening space of the fixing component.

The rest parts of the present embodiment are the same as those in Embodiment 1, Embodiment 2, Embodiment 3 or Embodiment 4.

Embodiment 6

Compared with Embodiment 1, Embodiment 2, Embodiment 3, Embodiment 4, or Embodiment 5, in the present embodiment, the plug-in three-dimensional circuit connector module, which can be arbitrarily bent and fixed, is another circuit connector.

Figure 27:
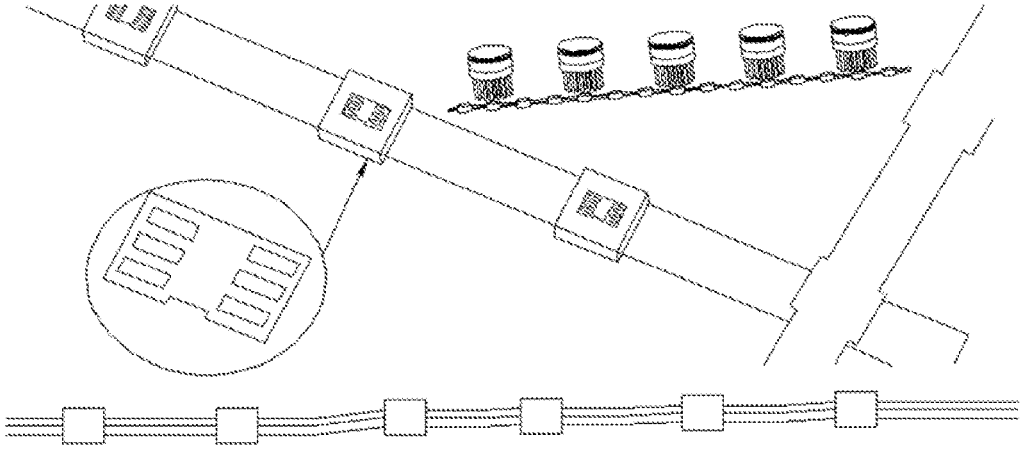
FIG. 27 is the schematic diagram of the circuit connector in Embodiment 6.

As shown in FIG. 27, in the present embodiment, the circuit connector includes an insulative flexible circuit board, a plurality of male and female plugs and adaptors. Through different plug-in manners, series circuit, parallel circuit, or hybrid circuit can be formed.

The rest part of the present embodiment is the same as that in Embodiment 1, Embodiment 2, Embodiment 3, Embodiment 4, or Embodiment 5.

It should be noted that all the features, all the steps in the method or the process disclosed in the specification, can be combined in any manner, except for mutually exclusive features and/or steps.

Moreover, the above specific embodiments are exemplary. A person of ordinary skill in the art can conceive all kinds of solutions under the inspiration of the disclosure of the present invention. Such solutions belong to the disclosure of the present invention and fall within the protective scope of the present invention. A person of ordinary skill in the art should understand that the specification and drawings of the present invention are descriptive, but are not used to limit the claims. The protective scope of the present invention is defined by the claims and the equivalents.

What is claimed is:

1. An LED illuminating device with an arbitrary bending and fixing connector module, comprising:

a frame member module;

a housing of a lamp, a cover, and a piece-like internal and external cavity wall module;

a housing supporting and molding member module;

a decorative fastening member module;

a screw-in lens and decorative lighting module, in which a lens and a decorative lighting can be replaced arbitrarily;

a plug-in integrated light source module;

a plug-in three-dimensional circuit connector module, configured to be bent and fixed arbitrarily;

a plug-in power supply module;

wherein the frame member module includes a first cylindrical plastic metal composite part and a snap-in connecting part;

wherein an outer layer of the first cylindrical plastic metal composite part is plastic;

wherein a core of the first cylindrical plastic metal composite part includes a metal strip;

each side surface of the first cylindrical plastic metal composite part includes a first concave snap-in groove structure; wherein the first cylindrical plastic metal composite part has a first end and a second end; wherein the first and second ends each include a second concave snap-in groove structure;

wherein the snap-in connecting part is configured to be a structure to snap in one of the first concave snap-in groove structure and the second concave snap-in groove structure;

wherein the housing of the lamp, is flexible metal piece-like, plastic piece-like, fabric film, paper, or a piece-like module with any combination;

wherein the cover is flexible metal piece-like, plastic piece-like, fabric film, paper, or a piece-like module with any combination;

wherein the piece-like internal and external cavity wall is flexible metal piece-like, plastic piece-like, fabric film, paper, or a piece-like module with any combination;

wherein a piece-like module material is inserted into one of the first concave snap-in groove structure_and the second concave snap-in groove structure in the frame member module to form an internal or external housing of the lamp, or form a closed or unclosed cavity inside the lamp, so as to form the housing of the lamp, the cover, and the piece-like internal and external cavity wall module;

wherein a surface of the piece-like module material is carved, coated, sprayed, or printed with a design;

the housing supporting and molding member module includes a supporting and molding member;

wherein the supporting and molding member has a multilayer piece-like structure;

wherein the number of layers in the multiplayer piece-like structure is N;

wherein N is an odd number equal to or greater than 3;

wherein the multilayer piece-like structure is arranged from top to bottom in an order of one plastic layer and one metal layer in an alternate manner;

wherein the multilayer piece-like structure has an uppermost layer and a lowermost layer wherein the uppermost layer and the lowermost layer of the multilayer piece-like structure are plastic layers;

wherein a mechanical strength of the supporting and molding member is configured in such a way that the supporting and molding member can be bent or tailored arbitrarily by manpower to form a supporting member of the housing of the lamp, the cover, or a flexible film material of the lamp;

wherein the decorative fastening member module includes a second cylindrical plastic metal composite part, an H-shaped snap-in connecting part, and an L-shaped or U-shaped fastening sealing strip with a snap joint;

wherein the second cylindrical plastic metal composite part has one or more side surfaces and each side surface of the second cylindrical plastic metal composite part is provided with a concave snap-in groove structure;

wherein the H-shaped snap-in connecting part is configured to be a structure snapping in the concave snap-in groove structure of the second cylindrical plastic metal composite part;

a middle portion of each H-shaped snap-in connecting part is provided with a via hole;

the L-shaped or U-shaped fastening sealing strip with the snap joint is configured to snap in an external side surface of the second cylindrical plastic metal composite part;

the screw-in lens and decorative lighting module includes a screw-in secondary light distribution lens;

an internal side of an outer wall of the secondary light distribution lens is fixed to the plug-in integrated light source module in a screw-in manner;

the plug-in three-dimensional circuit connector module includes a connector;

the connector includes a plurality of connecting units;

each connecting unit is provided with a connecting point;

each connecting unit can be bent and fixed arbitrarily;

the plurality of connecting units are connected to each other through the connecting point;

the plug-in integrated light source module comprises at least one lamp bead body, an LED chip and a circuit, and a plug-in component;

a lower part of the lamp bead body is designed as a heat dissipation structure;

an upper part of the lamp bead body is packaged with the LED chip and the circuit;

the plug-in integrated light source module has an integrated whole packaging structure;

wherein the decorative fastening member is fixed in the frame member module;

the plug-in integrated light source module is plugged into the plug-in three-dimensional circuit connector module through the plug-in component and the plug-in three-dimensional circuit connector module is connected to the plug-in power supply module; and wherein the frame member module and housing surround the light plug-in intergrated source module.

2. The LED illuminating device with the arbitrary bending and fixing connector module according to claim 1, wherein the plug-in integrated light source module includes a plurality of lamp bead bodies;

a geometric center of an upper surface of each lamp bead body is provided with a projecting lamp cup by injection molding;

the lamp cup is an inversed flat-topped quadrangular pyramid groove;

the lamp cup is provided with a LED chip;

a lens is provided in an illuminating optical path of LED and is configured to diffuse rays;

an upper surface of the lamp bead body is further provided with two grooves;

the two grooves are respectively positioned on both sides of the lamp cup and correspond to each other;

a set of positive and negative poles circuits is provided in the two grooves;

the positive and negative pole circuits of the lamp bead are wrapped within the two grooves by injection molding to achieve insulation;

one end of the positive and negative pole circuits of the lamp bead is connected to the LED chip, the other end of the positive and negative pole circuits of the lamp bead is exposed to an outside of one of the two grooves, so that the positive and negative poles are formed on both sides of the lamp bead;

the positive and negative poles on both sides of the lamp bead form a male plug of a male and female plug structure by injection molding;

the end of the positive and negative pole circuits of the lamp bead which is exposed to the outside of the grooves is positioned in the male plug; and a lower part of the lamp bead body is configured to be a heat dissipation structure.

* * * * *